US005592724A

United States Patent [19]

Linville et al.

[11] Patent Number: 5,592,724

[45] Date of Patent: Jan. 14, 1997

[54] MECHANISM FOR LIFTING AND TILTING THE BED OF A CASKET

[75] Inventors: John E. Linville, Osgood, Ind.; Olan L. Long, Columbus, Ohio

[73] Assignee: Batesville Casket Company, Inc., Batesville, Ind.

[21] Appl. No.: 195,867

[22] Filed: Feb. 14, 1994

[51] Int. Cl.[6] ..... A61G 17/00

[52] U.S. Cl. ..... 27/12; 5/611

[58] Field of Search ..... 27/1, 2, 12, 32; 5/607, 611, 11; 414/639–642, 422, 419, 420

[56] References Cited

U.S. PATENT DOCUMENTS

| | | | |
|---|---|---|---|
| 247,496 | 9/1881 | Goodwin . | |
| 1,667,982 | 5/1928 | Pearson . | |
| 2,670,517 | 3/1954 | Hillenbrand et al. . | |
| 3,653,104 | 4/1972 | Nelson . | |
| 4,070,737 | 1/1978 | Peterson . | |
| 4,332,064 | 6/1982 | Foust . | |
| 4,403,380 | 9/1983 | Hazelett et al. . | |
| 4,404,716 | 9/1983 | Foust . | |
| 4,524,472 | 6/1985 | Foust . | |
| 4,621,395 | 11/1986 | Benoit . | |
| 5,064,337 | 11/1991 | Asakawa et al. | 414/639 |
| 5,231,741 | 8/1993 | Maguire . | |
| 5,379,814 | 1/1995 | Posly | 414/621 X |

OTHER PUBLICATIONS

Victoriaville EnviroBed Advertisement.

*Primary Examiner*—Carl D. Friedman
*Assistant Examiner*—Beth A. Aubrey
*Attorney, Agent, or Firm*—Wood, Herron & Evans

[57] ABSTRACT

A casket having a fully combustible, full height lift mechanism for raising and lowering the bed of the casket and for rotating the bed about the longitudinal axis of the casket that includes an integral C-shaped bracket that supports a drive screw, a seat that threadably engages the drive screw for supporting the bed frame of the casket, and integral fasteners for securing the assembly to the casket. The mechanism may include a tilt mechanism supported within the C-shaped bracket. In one embodiment, the tilt mechanism restrains one edge of the seat such that continued rotation of the drive screw rotates the seat. In another embodiment, the tilt mechanism drives an edge of the seat such that rotation of the tilt mechanism rotates the seat.

29 Claims, 5 Drawing Sheets

MECHANISM FOR LIFTING AND TILTING THE BED OF A CASKET

FIELD OF THE INVENTION

The present invention relates generally to caskets and more particularly to a mechanism for raising and lowering the bed of a casket and for rotation of the bed about the casket longitudinal axis.

BACKGROUND OF THE INVENTION

Bed frames of various types and kinds are now in use in caskets and have been for many years. The bed frame, in conjunction with pillows and mattresses, is used to support the deceased. To assist in casketing the body and adjusting the position of the body, the bed frame is typically mounted on a lift mechanism that raises and lowers the vertical position of the casket bed. Additionally, to provide viewers with a more direct and natural view of the deceased, one end of the bed frame is generally made tiltable or rotatable about the longitudinal axis of the casket. Although existing devices are able to perform the desired functions, they nonetheless suffer certain drawbacks. In particular, the lift mechanisms typically use an upright L-shaped bracket with the bed frame resting on the foot of the "L" and the leg of the "L" being threaded to threadedly engage a drive screw. This arrangement prevents the bed frame from being raised to the top edge of the casket, thereby making it difficult to casket the body.

In Hillenbrand U.S. Pat. No. 2,670,517, the bed frame may, however, be raised flush with the top edge of the casket. This is accomplished by mounting the bed frame on the top of a bed frame supporting bracket rather than in a lower portion of an "L" bracket. The bracket is pivotally mounted with a rivet to a plate that is, in turn, threadably mounted on a drive shaft. The height of the bed frame is adjusted via the drive shaft. To tilt the bed frame, a separate shaft is mounted in the casket parallel to the drive shaft and slidably supports a gear that meshes with teeth on the bracket such that rotation of the gear via the gear shaft tilts the bracket and bed frame.

The existing devices suffer additional deficiencies. The numerous components of the various lift mechanisms are typically manufactured from metal. Although this is satisfactory for conventional interment, the use of metal components causes difficulties when cremation is chosen. In addition, each of the numerous components of the lift mechanism are either separately secured directly to the casket or assembly of the mechanism mandates that at least some of the components be first secured within the casket requiring considerable time and effort in the assembly operation of the mechanism into the casket.

Attempts have been made to manufacture lift mechanisms from wood to render them combustible, but these too have created difficulties. First, wood is difficult to work with, i.e., difficult to fashion into the desired functional lift elements. Further, the wood components may gall or splinter in use, particularly with the weight that is applied. Still further, wood is expensive to use.

Therefore, there has been a significant need for lift and lift/tilt mechanisms for the bed of a casket that permit the bed frame to be raised to the top of the casket frame, are fully combustible, and can be easily and quickly attached to the casket.

SUMMARY OF THE INVENTION

In accordance with the principles of the present invention and a preferred embodiment thereof, a casket is provided having a shell with two end walls and two side walls, a bed frame, and a lift mechanism that is mounted to each of the end walls of the casket shell for raising and lowering of the bed frame. Each of the lift mechanisms has an elongated integral C-shaped bracket, a threaded drive screw supported in the bracket, a seat threadably engaging the drive screw for supporting the bed frame, and fasteners integrally associated with the C-shaped bracket for securing the lift mechanism to the casket shell. Preferably, the lift mechanism and all of its components are manufactured from a material that is fully combustible, such as plastic.

To enable the casket bed to be raised level with the top edge of the casket wall, threads are formed along substantially the entire length of the drive screw. Further, rather than being threaded above the bed frame supporting surface, the seat is threaded below the bed frame supporting surface. This, along with a reduction in overall height of the seat, enables the seat that supports the bed frame to be raised to within about one inch of the top edge of the casket shell without compromising the full lowering capability of the seat.

Preferably, the fasteners that are integrally associated with the C-shaped bracket are Christmas tree type fasteners that may be press-fitted into holes that are preformed into the end walls of the casket shell.

If the casket is of the type that only includes a lift feature associated with the lift mechanism, the seat that supports the bed frame is preferably an inverted L-shaped flange having a first leg that extends substantially perpendicularly from the drive screw and a second leg that extends downwardly from the first leg. Additionally, the seat includes a threaded portion for threadably engaging the drive screw.

For those caskets wherein the lift mechanism is to include a tilt feature, at least one of the lift mechanisms includes a tilt mechanism for pivoting the bed frame about the longitudinal axis of the casket. In one embodiment, the seat of the lift/tilt mechanism is rotatably supported on a hub that includes threads for threadably engaging the drive screw. The tilt mechanism consists of a rack that is rotatably supported in the bracket having a number of teeth therealong with mating teeth on the edge of the seat. The rack may be rotated between a first position and a second position wherein the seat teeth matingly engage the rack teeth when the rack is in the second position but not when the rack is in the first position. When the rack is in the first position, the seat supporting the bed frame may be raised and lowered by rotating the drive screw. To tilt the bed frame, the rack is placed into the second position whereby the rack teeth matingly engage the seat teeth restraining one edge of the seat and thus restraining the vertical motion thereof such that continued rotation of the drive screw causes the seat and the bed frame to rotate about the hub.

In another embodiment, the tilt mechanism includes a tilt rod that is supported in the C-shaped bracket, a tilt nut that is splined to the tilt rod and having external threads thereon, a leg extending from the hub that captures the tilt nut, and teeth on the seat that matingly engage the tilt nut threads. When the tilt rod is rotated, the tilt nut threads mesh with the seat teeth, thereby rotating the seat and the bed frame about the hub.

virtue of the foregoing, there is thus provided a mechanism permitting the casket bed frame to be raised substantially level to the top of the casket frame, which is fully combustible, and which is quickly and easily assembled to the inside of the casket. Further, a mechanism permitting tilting of the bed frame about the longitudinal axis of the bed that reliably supports the bed frame is, likewise, provided. These and other objects and advantages of the present invention shall become apparent from the accompanying drawings and the detailed description thereof.

DETAILED DESCRIPTION OF THE DRAWINGS

The accompanying drawings, which are incorporated in and constitute a part of this specification, illustrate embodiments of the invention and, together with a detailed description of the invention given below, serve to explain the principles of the present invention.

DETAILED DESCRIPTION OF THE INVENTION

Figure 1:
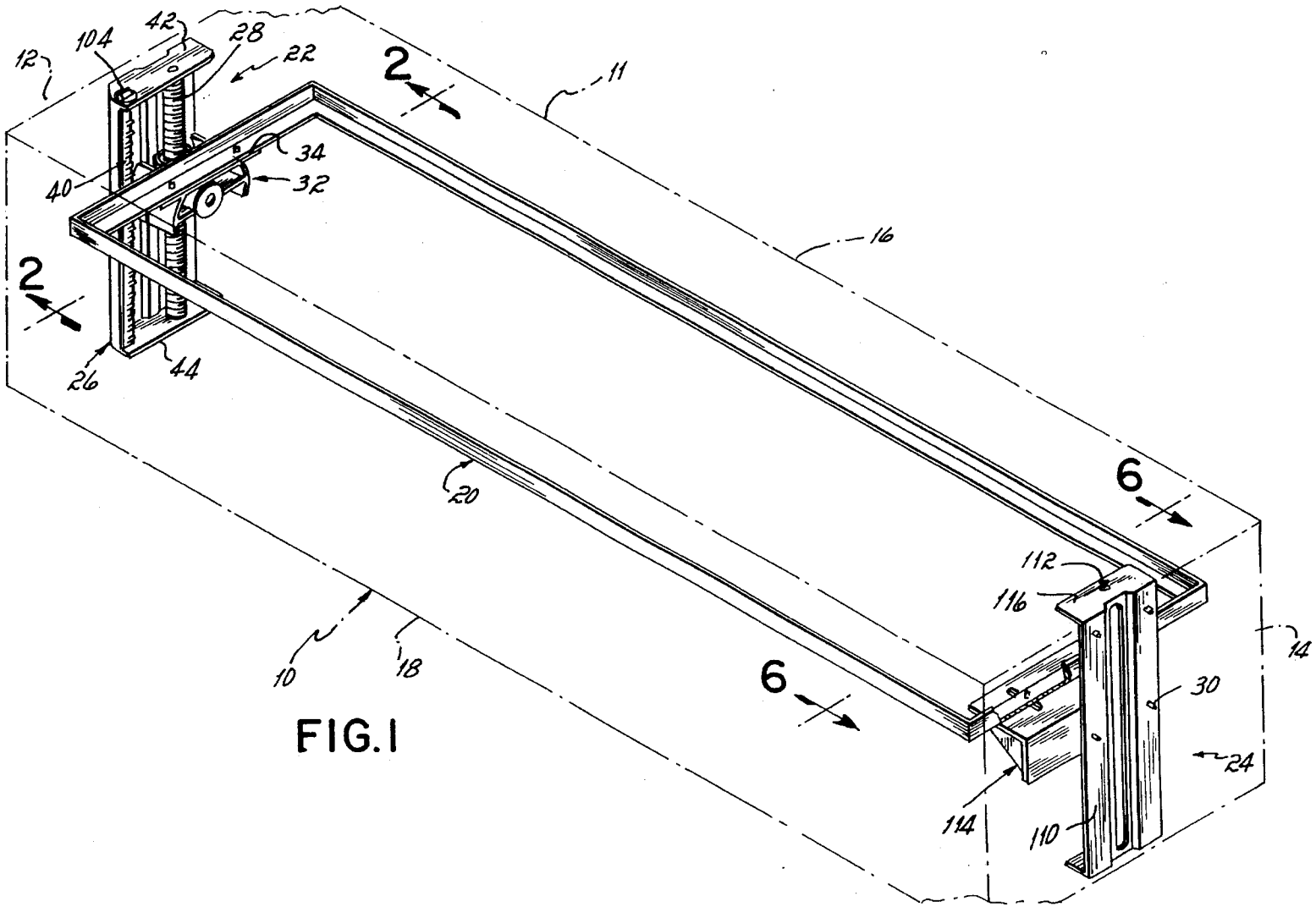
FIG. 1 is a perspective view of a casket bed frame including the lift/tilt mechanism of the present invention.
Figure 3:
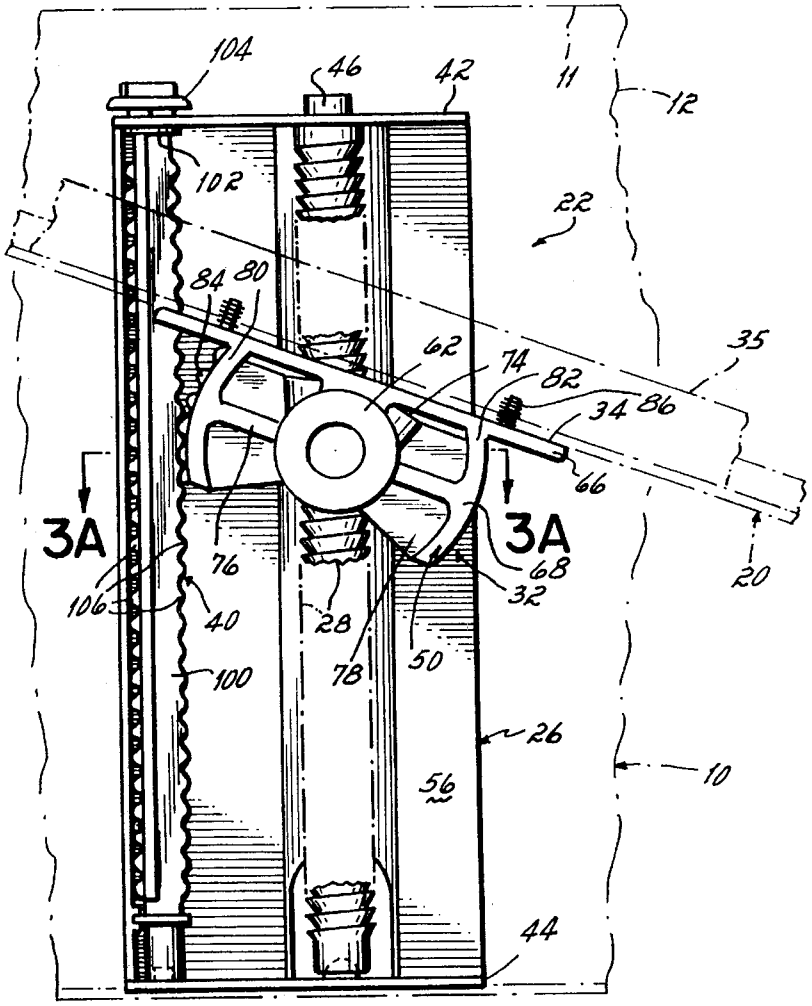
FIG. 3 is an enlarged front elevational view of the lift/tilt mechanism of FIG. 2 but/with the rack in the locked position.

With reference to FIG. 1, there is shown a casket shell 10 having end walls 12, 14 and side walls 16, 18. Within casket shell 10 is a bed frame 20, a lift/tilt mechanism 22 secured to end wall 12 and a lift mechanism 24 secured to end wall 14 that support bed frame 20 thereon. Generally only one lift/tilt mechanism is required because of the inherent flexibility of bed frame 20. However, although casket shell 10 as described includes a lift/tilt mechanism 22 and a lift mechanism 24, it will be readily appreciated by those skilled in the art that both mechanisms can be of the lift variety or the lift/tilt variety.

Lift/tilt mechanism 22 and lift mechanism 24 include elongated, integral C-shaped brackets 26, 110, respectively. Threaded drive screw 28 forms a part of mechanism 22 and is supported in C-shaped bracket 26 for use in raising and lowering bed frame 20. A plurality of fasteners 30 are integrally associated with the backs of the brackets 26, 110 and are for securing lift/tilt mechanism 22 and lift mechanism 24 to casket shell 10. A seat 32 also forms a part of mechanism 22 and threadably engages threaded drive screw 28, supporting bed frame 20 along the top surface 34 of seat 32. Seat 32 has an overall height of about 2 to about 2.5 inches and drive screw 28 includes threads along substantially its entire length. By supporting bed frame 20 on seat top surface 34 and above the threaded portion of the seat 32, providing seat 32 with a small overall height, and threading the entire length of drive screw 28, and providing seat 114 and drive screw 112 of mechanism 24 with similar qualities and features, lift/tilt mechanism 22 and lift mechanism 24 have a full height capability. That is, bed frame 20 may be raised to a height such that the casket mattress 35, which rests upon bed frame 20, is substantially level with the top edge 11 of casket shell 10 for casketing of the body while not compromising the full lowering capability of the seat and bed frame (see FIG. 2).

Referring to FIGS. 2–5, a lift/tilt mechanism 22 in accordance with the principles of the present invention is shown. As noted above, lift/tilt mechanism 22 comprises a generally C-shaped bracket 26, a threaded drive screw 28, integral fasteners 30, and a seat 32 threadably engaging the drive screw 28 for supporting bed frame 20. Additionally, lift/tilt mechanism 22 includes a tilt mechanism 40 for tilting of bed frame 20 about the longitudinal axis of casket shell 10 as will be described below.

Drive screw 28 is rotatably supported in the upper and lower flange portions 42, 44 of C-shaped bracket 26 and is used for raising and lowering bed frame 20. To enable a funeral director to rotate drive screw 28, thereby raising and lowering bed frame 20, drive screw 28 extends upwardly through upper flange portion 42 and terminates in a hex socket 46 for receiving the hex head of a standard casket key.

Seat 32 is threadably mounted on drive screw 28 for supporting bed frame 20 thereon. Seat 32 comprises an elongated cylindrical hub 48 oriented generally perpendicularly to drive screw 28 and a bed frame support 50 that is rotatably supported on hub 48.

Hub 48 has a first end 52 extending rearwardly through a slot 54 formed in the back wall 56 of C-shaped flange 26, a threaded bore 58 for mating engagement with threaded drive screw 28, and a second end 60 having a cylindrical flange 62 thereon. Hub 48 is captured in slot 54 by a cap 64 secured to hub first end 52.

Bed frame support 50 comprises a plate 66 for supporting bed frame 20 thereon and a body 68 for supporting plate 66. Body 68 includes a cylindrical center portion 70 oriented generally perpendicularly to drive screw 28 having a bore 72 therethrough sized to receive hub 48, a vertically oriented cross bore 74 to permit passage of drive screw 28, a horizontally oriented center plate 76 extending outwardly from center portion 70, a vertically oriented rear plate 78 extending outwardly from center portion 70 at approximately the center of cross bore 74, and arcuate side walls 80, 82 that are substantially vertically oriented on either side of center portion 70. Additionally, arcuate side wall 80 includes teeth 84 extending outwardly therefrom for a purpose to be described below. Finally, plate 66 includes integral fasteners 86 extending vertically upward therethrough for use in securing bed frame 20 thereto, Preferably, integral fasteners 86 are of the Christmas tree type, which permit securing bed frame 20 to plate 66 by press-fitting integral fasteners 86 into preformed holes in bed frame 20. However, it will be readily appreciated by those skilled in the art that other configurations of body 68 and other fasteners 86 may be used.

Figure 2:
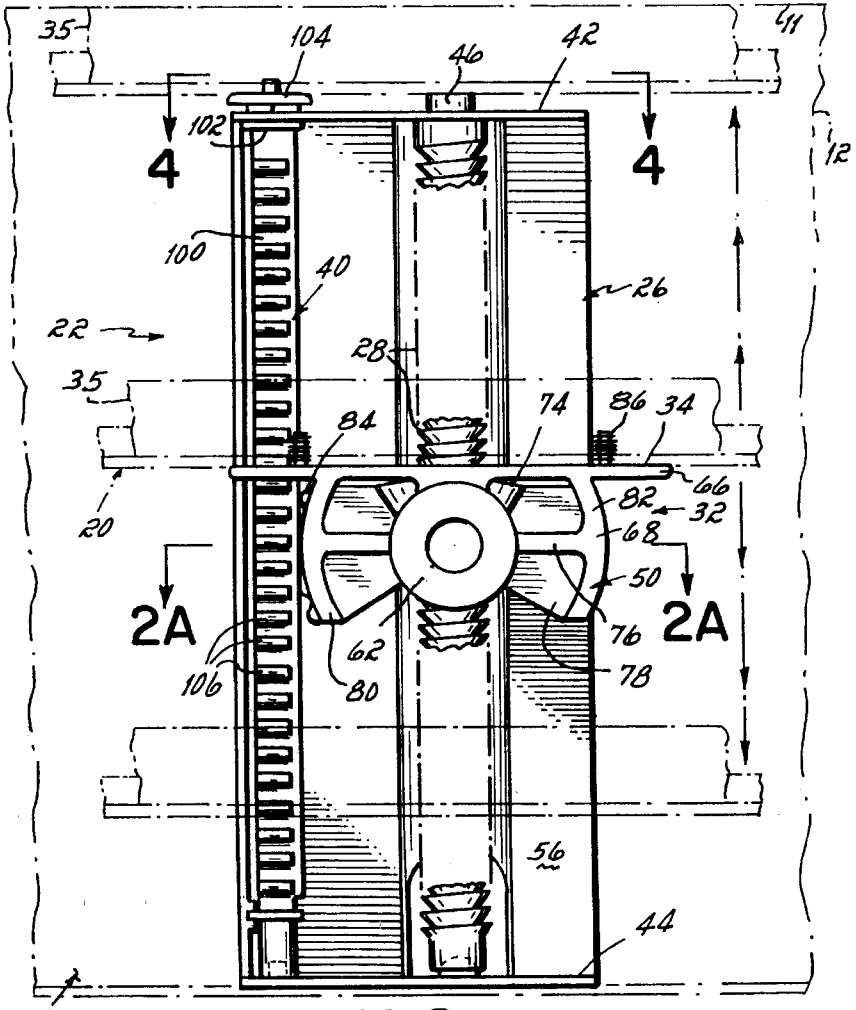
FIG. 2 is an enlarged front elevational view of the lift/tilt mechanism taken along 2—2 of FIG. 1 showing the rack in the unlocked position.

As shown in FIG. 2, the above described configuration for seat 32 enables bed frame 20 to be raised to the fullest height possible. Preferably, the seat top surface 34 may be raised to within about one inch of the top edge 11 of the casket shell 10. In this position, mattress 35 is substantially level with the top edge 11 of casket shell 10. Additionally, the construction of body 68, which reduces the overall height of seat 32 as compared to existing devices, still permits full lowering capability of the seat. Further, to provide a broader range of height adjustment as compared to existing lift/tilt mechanisms, drive screw 28 has threads formed 15 along substantially its entire length. The threading along substantially the entire length of drive screw 28 is possible because drive screw 28 and all of the components of lift/tilt mechanism 22 and lift mechanism 24 are preferably manufactured from plastic, which provides several advantages. First, it is possible to form or mold threads along the entire length of drive screw 28. In existing devices, the components are typically manufactured from metal. Thus, the length of threading on the drive screw is limited by the need to cut the threads into the drive screw, which requires a chuck for attachment of the screw to a machine. Next, plastic is lighter in weight and less expensive than metal. Finally, plastic is combustible, which overcomes a major problem associated with existing devices. The metal components of existing lift/tilt mechanisms and lift mechanisms cause difficulties in the cremation process as they cannot readily be burned. In contrast, by manufacturing the lift/tilt and lift mechanisms completely from plastic, the entire casket, except for incidental external fixtures and hinges, for example, is fully combustible.

The tilt function in the present invention is provided by a tilt mechanism 40 that is incorporated within C-shaped channel 26. Specifically, a vertically oriented rack 100 is supported substantially parallel to drive screw 28 in upper and lower flange portions 42, 44 of C-shaped bracket 26. As with drive screw 28, rack 100 extends upwardly through upper flange portion 42 terminating in a hex socket 102 for receiving a knob 104 thereon. Rack 100 includes teeth 106 along opposed surfaces and is rotatable between a first position at 0° and a second position at 90° by rotation of knob 104.

Figure 3A:
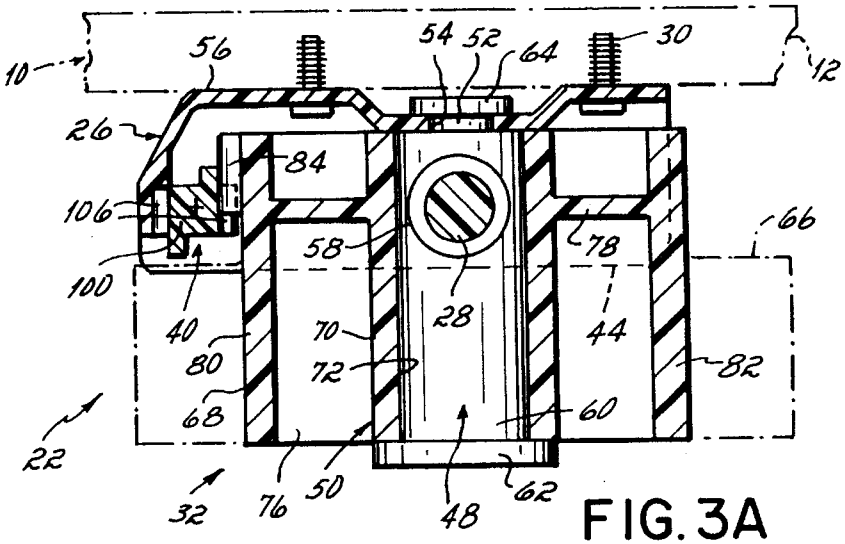
FIG. 3A is a view taken along 3A—3A of FIG. 3.
Figure 5:
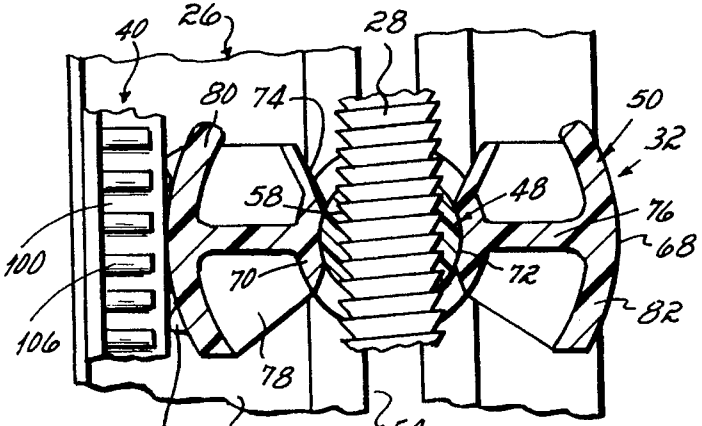
FIG. 5 is a view taken along 5—5 of FIG. 4.
Figure 2A:
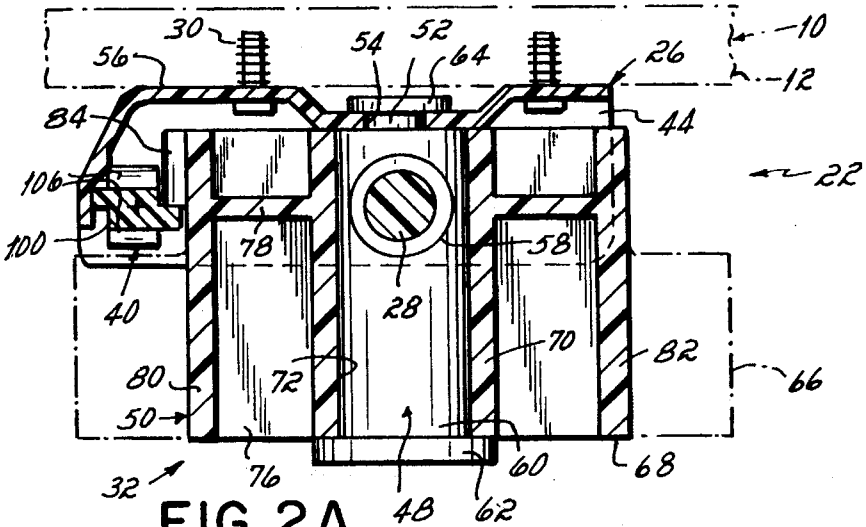
FIG. 2A is a view taken along 2A—2A of FIG. 2.
Figure 4:
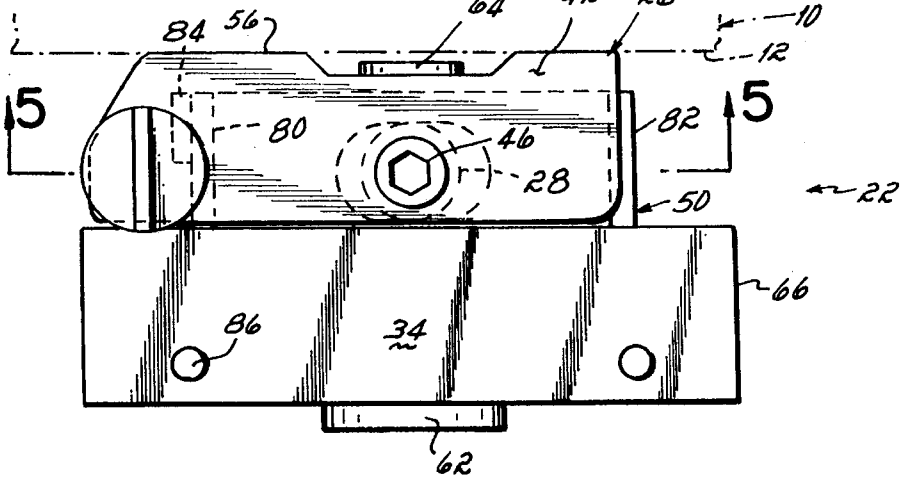
FIG. 4 is a top elevational view of the lift/tilt mechanism taken along 4—4 of FIG. 1.

When rack 100 is in the first position, rack teeth 106 are not in engagement with seat teeth 84 (see FIGS. 2 and 2A). In this configuration, rotation of drive screw 28 by a hex head casket key causes seat 32 to be raised and lowered. In contrast, when knob 104 is rotated 90°, thereby rotating rack 100 into the second position, rack teeth 106 are placed in mating engagement with seat teeth 84, thereby restraining that portion of seat 32 and thus restraining vertical motion thereof (see FIGS. 3 and 3A). Continued rotation of drive screw 28 thus causes bed frame support 50 to rotate about hub 48, which in turn rotates bed frame 20 about the longitudinal axis of casket shell 10.

Lift/tilt mechanism 22 provides several advantages over existing lift/tilt mechanisms. The use of hex socket 46 for raising and lowering bed frame 20 and knob 104 for rotating rack 100 between the first and second positions eliminates the confusion associated with existing devices wherein both functions are accomplished through identical hex sockets. Also, by locking a portion of seat 32 and tilting bed frame 20 through continued rotation of drive screw 28 rather than independently driving seat 32 by rotation of a separate tilt screw, the complexity of the mechanism is reduced.

Finally, to secure lift/tilt mechanism 22 to casket shell 10, a plurality of integral fasteners 30 extends through back wall 56 of C-shaped flange 26. Preferably, integral fasteners 30 are of the Christmas tree type such that they may be press-fitted into preformed holes in the end wall 12 of casket shell 10. However, it will be readily appreciated by those skilled in the art that other fasteners may be used without departing from the scope or the spirit of the present invention.

To assemble lift/tilt mechanism 22, bed frame support 50 is placed over hub 68 and rests against flange 62. Drive screw 28 is threadably inserted through threaded bore 58. Rack 100 is then placed into C-shaped-bracket 26. The assembly is completed by inserting drive screw 28 into C-shaped bracket 26 and placing cap 64 over the hub first end 52. Finally, the entire lift/tilt mechanism is conveniently press-fitted into the preformed holes (not shown) in the end wall 12 of casket shell 10.

Figures 6, 7, 8:
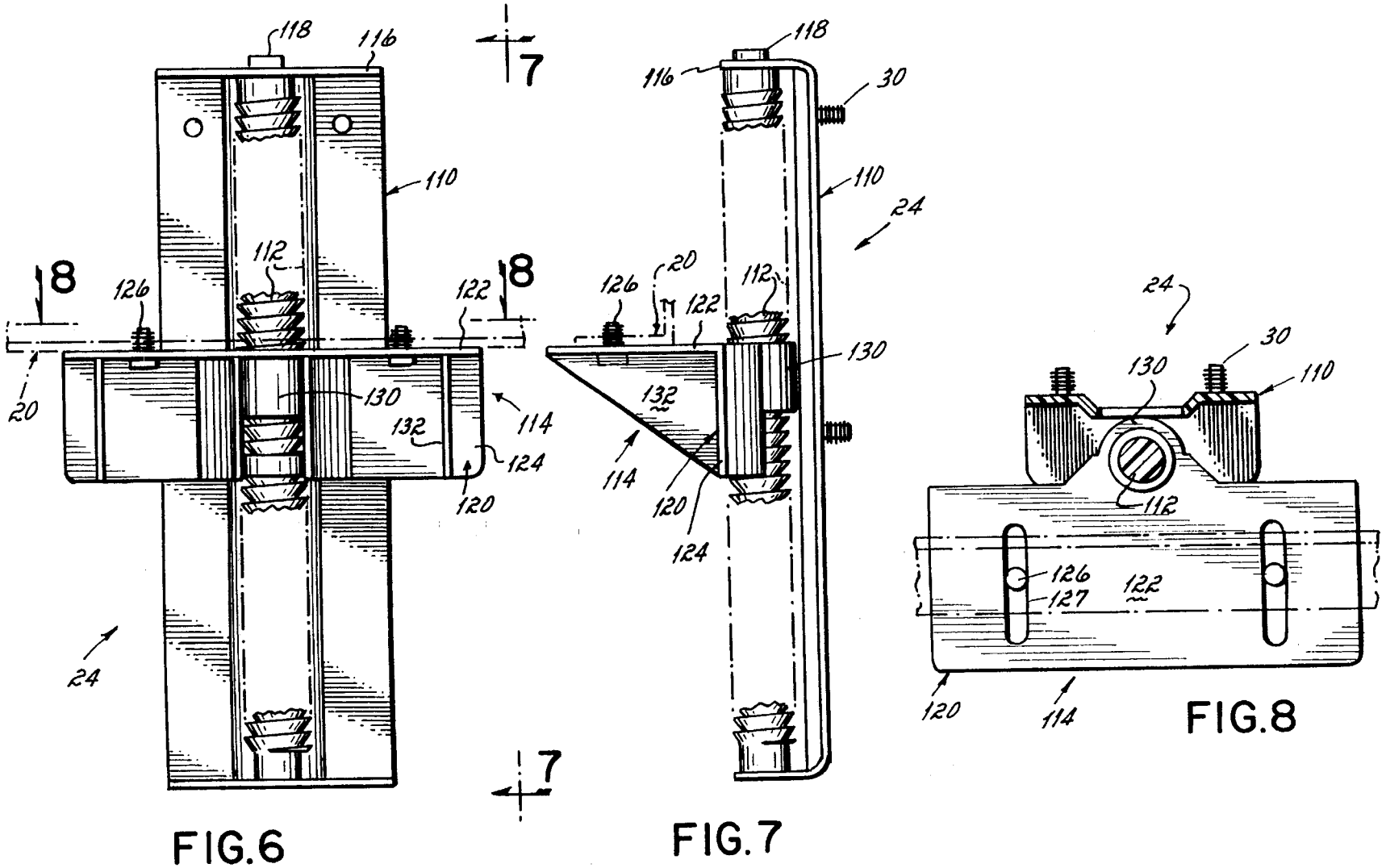
FIG. 6 is a front elevational view taken along 6—6 of FIG. 1 showing a lift mechanism made in accordance with the principles of the present invention.
FIG. 7 is a side elevational view of the lift mechanism taken along 7—7 of FIG. 6.
FIG. 8 is a top elevational view of the lift mechanism taken along 8—8 of FIG. 6.

With reference to FIGS. 6–8, there is shown a lift mechanism 24 made in accordance with the principles of the present invention. Lift mechanism 24 comprises the above-mentioned C-shaped bracket 110, threaded drive screw 112 rotatably supported in C-shaped bracket 110 and seat 114 for supporting bed frame 20. C-shaped bracket 110 is of the same basic configuration as that used for lift/tilt mechanism 22 and drive screw 112 is preferably the same as that used for lift/tilt mechanism 22. This provides for lower cost in the manufacturing process and greater ease in assembly. As before, drive screw 110 extends upwardly through upper flange 116 of C-shaped bracket 110, terminating in a hex socket 118 sized to receive a standard casket key. Further, C-shaped bracket 110 includes a plurality of integral fasteners 30 of the same type used on lift/tilt mechanism 22.

Seat 114 includes an inverted L-shaped flange 120 having a first leg 122 extending generally perpendicularly to drive screw 112 that supports bed frame 20 thereabove and a second leg 124 extending generally downwardly from first leg 122. Integral fasteners 126 are slidably retained within slots 127 formed in first leg 122. Fasteners 126 are preferably of the Christmas tree type for press-fitting into preformed holes in bed frame 20. By slidably retaining fasteners 126 in slots 127, slight variations in the placement of the holes in bed frame 20 may be accommodated. Extending rearwardly from second leg 124, and below first leg 122, is a threaded portion 130 for threadable engagement with drive screw 112. Finally, a plurality of triangular braces 132 may be included to interconnect first leg 122 and second leg 124 and provide additional support.

Figure 8A:
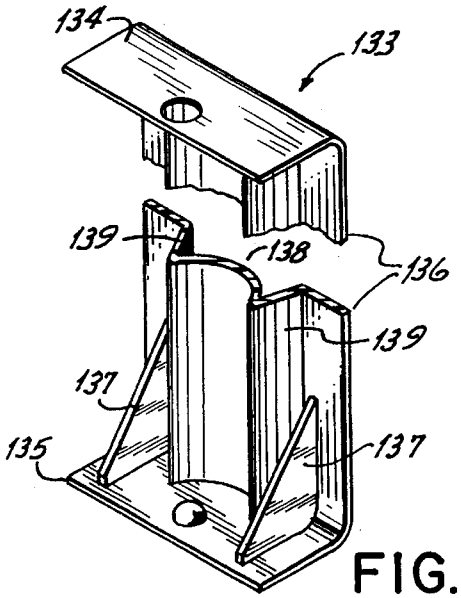
FIG. 8A is a front perspective view, partially broken, of another bracket for use with the lift mechanism of FIG, 6.

With reference to FIG. 8A, there is shown a preferred form of a C-shaped bracket 133 for use with lift mechanism 24. C-shaped bracket 133 includes upper and lower flange portions 134, 135, respectively, a back wall 136, and a pair of gussets 137 interconnecting lower flange portion 135 and back wall 136. Back wall 136 comprises a center portion 138 having a forwardly projecting substantially U-shaped cross section with a pair of wings 139 extending outwardly therefrom. Center portion 138 and gussets 137 provide additional rigidity to C-shaped bracket 133.

Together, lift/tilt mechanism 22 and lift mechanism 24 cooperate to provide a means for adjusting the height and tilt of a bed frame 20 of a casket shell 10. By manufacturing the mechanisms solely from plastic, the cost associated with the devices is lower than with existing devices. Additionally, unlike existing devices manufactured from metal, the mechanisms of the present invention are fully combustible and, thus, do not cause the problems associated with metal lift and lift/tilt mechanisms during the cremation process. Further, by pre-assembling the mechanisms before placement within the casket, the time needed for assembly is greatly reduced. Finally, the use of integral fasteners 30 that may be press-fitted into preformed holes in casket shell 10 further reduces the time needed for assembly.

In use, to casket a body, rack 100 is placed in the first position by rotating knob 104 such that rack teeth 106 are disengaged from seat teeth 84. Drive screw 28 is rotated by a standard hex head casket key to raise seat 32 and bed frame 20 to the uppermost position. Similarly, drive screw 112 is rotated to raise seat 114 to its uppermost position. The funeral director may then easily move the deceased from the preparation table to the casket. Drive screws 28, 112 are then rotated in the opposite direction to lower seats 32, 114 to the desired location. To tilt bed frame 20, so as to improve the appearance of the deceased, the funeral director rotates knob 104 90° placing rack 100 in the second position, thereby engaging rack teeth 106 and seat teeth 84 and locking that portion of seat 32. The funeral director continues to rotate drive screw 28, which causes bed frame support 50 to rotate about hub 48, and, in turn, twist bed frame 20 about the longitudinal axis of casket shell 10.

Figure 10:
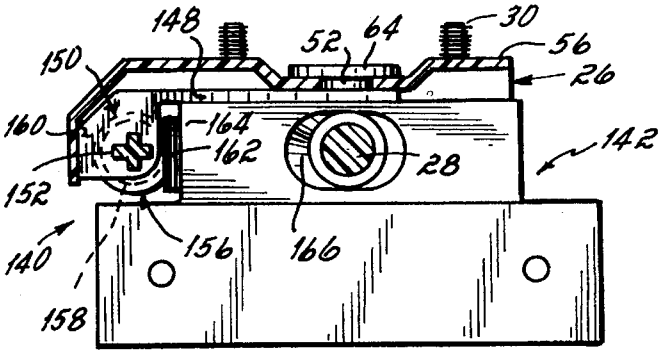
FIG. 10 is a sectional view of the lift/tilt mechanism taken along 10—10 of FIG. 9.
Figure 9:
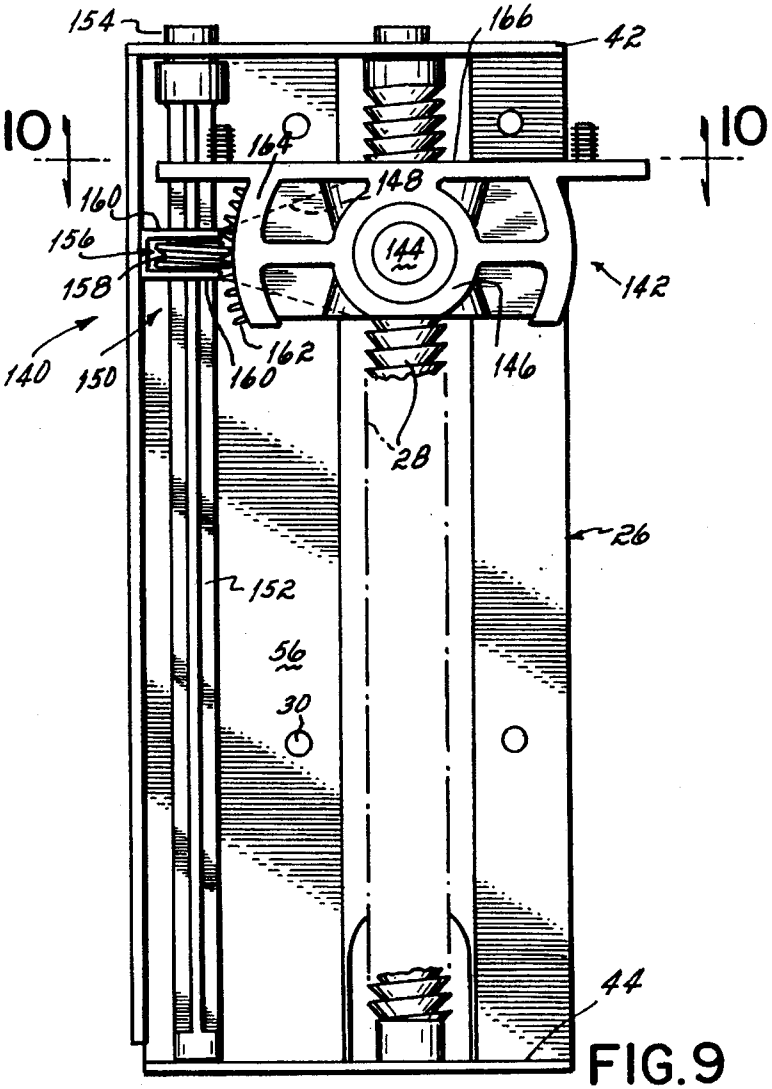
FIG. 9 is an enlarged front elevational view of another lift/tilt mechanism made in accordance with the principles of the present invention.

Another lift/tilt mechanism in accordance with the principles of the present invention is shown in FIGS. 9 and 10 with like parts having like numbers. As before lift/tilt mechanism 140 comprises a drive screw 28 that is rotatably supported in a C-shaped bracket 26, integral fasteners 30 extend rearwardly through back wall 56 of C-shaped flange 26, and a seat 142 that supports bed frame 20 thereon. Seat 142 is of the same basic configuration as in the first embodiment and includes a hub 144 with a bed frame support 146 rotatably supported thereon. However, hub 144 includes a leg 148 extending laterally outward from first end 52 of hub 144 toward tilt mechanism 150 for a purpose to be described below.

Tilt mechanism 150 comprises a vertically oriented tilt rod 152 that is rotatably supported within C-shaped bracket 26 and is substantially parallel to drive screw 28. Tilt rod 152 extends vertically upward through upper flange portion 42 terminating in a hex socket 154 that is sized to receive a standard casket key. A tilt nut 156, which has external threads 158 thereon, is splined onto tilt rod 152 such that tilt nut 156 may slide vertically along tilt rod 152 but is restrained from moving rotationally relative thereto. Tilt nut 156 is captured between fingers 160 of leg 148 and external threads 158 matingly engage with seat teeth 162 extending from arcuate side wall 164 of bed frame support 146, Thus, rotation of tilt rod 152 causes tilt nut 156 to rotate thereby meshing with seat teeth 162 and rotating bed frame support 146.

To assemble lift/tilt mechanism 140, bed frame support 146 is placed over hub 144 and drive screw 28 is threadably engaged with threaded bore 166 of hub 144. Tilt nut 156 is placed between fingers 160 and tilt rod 152 is inserted through tilt nut 156. Then, tilt rod 152 and drive screw 28 are inserted into C-shaped bracket 26. Finally, cap 64 is placed over hub first end 52 and the entire assembly is secured to casket shell 10 by press-fitting integral fasteners 30 therein.

In use, to raise or lower bed frame 20, drive screw 28 is rotated by a standard casket key. This causes hub 144 and bed frame support 146 to be raised or lowered, which in turn causes tilt nut 156 to slidably move up or down tilt rod 152. To twist bed frame 20 about the longitudinal axis of casket shell 10, the funeral director places a standard casket key into hex socket 154 of tilt rod 152. Rotation of tilt rod 152 rotates tilt nut 156 causing threads 158 to mesh with seat teeth 162, thereby causing seat 142 and bed frame 20 to twist about the longitudinal axis of casket shell 10.

By virtue of the foregoing, there is thus provided lift and lift/tilt mechanisms that are fully combustible, provide full height adjustment for casketing of a body, and may be quickly and easily assembled as a single unit to a casket. Further, a mechanism is provided for tilting of the bed frame about the longitudinal axis of the casket.

While the present invention has been illustrated by description of embodiments that have been described in considerable detail, it is not the intention of the applicant to restrict or in any way limit the scope of the appended claims to such detail. Additional advantages will readily appear to those skilled in the art. Thus, the invention in its broadest aspects is not limited to the specific details, representative apparatus and illustrative examples shown and described. Accordingly, departures may be made from the details without departing from the spirit or scope of applicant's general inventive concept.

What is claimed is:

1. A casket comprising:

a shell having two end walls and two side walls;

a bed frame; and a lift mechanism mounted to each said end wall of said shell for raising and lowering said bed frame, each said lift mechanism having an elongated integral C-shaped bracket, a threaded drive screw supported in said C-shaped bracket, a seat threadably engaging said drive screw for supporting said bed frame, and fasteners integrally associated with said C-shaped bracket for securing said lift mechanism to said shell.

2. The casket of claim 1 wherein said lift mechanism is combustible.

3. The casket of claim 2 wherein said lift mechanism is made from plastic.

4. The casket of claim 1 wherein said side walls have a top edge, and said drive screw includes threads along substantially its entire length, whereby said seat may be raised to within about one inch of said top edge of said side walls without compromising the full lowering capability of said seat.

5. The casket of claim 1 wherein said end walls have holes formed therein, and said fasteners are Christmas tree type fasteners for press-fitting into said holes.

6. The casket of claim 1 wherein said seat comprises an inverted L-shaped flange having a first leg extending generally perpendicularly from said drive screw for supporting said bed frame, a second leg extending downwardly from said first leg and a threaded portion for threadably engaging said drive screw.

7. The casket of claim 1 wherein at least one of said lift mechanisms further includes a tilt mechanism for pivoting said bed frame about the longitudinal axis of said shell.

8. The casket of claim 7 wherein said seat of said at least one lift mechanism is rotatably supported on a hub, said hub having threads for threadably engaging said drive screw, said tilt mechanism comprising:

a tilt rod supported in said C-shaped bracket;

a tilt nut having external threads, said tilt nut being retained on said tilt rod such that said tilt nut is free to translate along said tilt rod but is restrained from rotating about said tilt rod;

said hub including a leg capturing said tilt nut; and teeth on said seat for matingly engaging said tilt nut threads, whereby when said tilt rod is rotated, said tilt nut threads mesh with said seat teeth rotating said seat and said bed frame about said hub.

9. The casket of claim 7 wherein said seat of said at least one of said lift mechanisms is rotatably supported on a hub, said hub having threads for threadably engaging said drive screw, said tilt mechanism comprising:

a rack having a number of teeth therealong and being supported in said C-shaped bracket, said rack being rotatable between a first position and a second position; and teeth on one edge of said seat for matingly engaging said rack teeth when said rack is in said second position, said rack teeth not engaging said seat teeth when said rack is in said first position, whereby when said rack is in said first position said seat may be raised and lowered by rotating said drive screw and when said rack is in said second position said rack teeth matingly engage said seat teeth restraining vertical motion of said one edge of said seat such that continued rotation of said drive screw causes said seat and said bed frame to rotate about said hub.

10. A casket comprising:

a shell having two end walls and two side walls, said end walls and said side walls having a top edge;

a bed frame; and a lift mechanism mounted to each said end wall of said shell for raising and lowering said bed frame, each said lift mechanism having an elongated integral C-shaped bracket secured to said end wall, a drive screw supported in said bracket and having threads substantially along its entire length and a seat threadably engaging said drive screw supporting said bed frame, said seat having a bed frame supporting surface and a threaded portion below said bed frame supporting surface for engagement by said drive screw, whereby said seat may be raised to within about one inch of said top edge of said side walls without compromising the full lowering capability of said seat.

11. The casket of claim 10 wherein said seat has an overall vertical dimension of about 2 to about 2.5 inches.

12. The casket of claim 10 wherein said lift mechanism is combustible.

13. The casket of claim 12 wherein said lift mechanism is made from plastic.

14. The casket of claim 10 wherein said end walls have holes formed therein, and said fasteners are an integral Christmas tree type fasteners for press-fitting into said holes.

15. For a casket having a shell with two end walls and two side walls and a bed frame, a lift and tilt mechanism mountable to the end walls comprising:

an elongated integral C-shaped bracket;

fasteners integrally associated with said C-shaped bracket for securing said C-shaped bracket to the end wall;

a threaded drive screw supported in said C-shaped bracket for raising and lowering the bed frame;

a tilt rod supported in said C-shaped bracket;

a tilt nut having external threads, said tilt nut being retained on said tilt rod such that said tilt nut is free to translate along said tilt rod but is restrained from rotating relative to said tilt rod;

a hub having threads for threadably engaging said drive screw, said hub including a leg capturing said tilt nut; and a seat rotatably mounted on said hub for supporting the bed frame, said seat including teeth for matingly engaging said tilt nut threads;

whereby said seat can be raised and lowered by rotation of said drive screw, and when said tilt rod is rotated, said tilt nut threads mesh with said seat teeth, rotating said seat and the bed frame about said hub.

16. The lift and tilt mechanism of claim 15 wherein said lift and tilt mechanism is combustible.

17. The lift and tilt mechanism of claim 16 wherein said lift and tilt mechanism is made from plastic.

18. For a casket having a shell with two end walls and two side walls and a bed frame, a lift and tilt mechanism mountable to the end walls comprising:

a bracket;

fasteners for securing said bracket to the end wall;

a threaded drive screw supported in said bracket for raising and lowering the bed frame;

a rack having a number of teeth therealong and being supported in said bracket, said rack being rotatable between a first position and a second position;

a hub having threads for threadably engaging said drive screw; and a seat rotatably mounted on said hub for supporting the bed frame, said seat including teeth on one edge thereof for matingly engaging said rack teeth when said rack is in said second position, said rack teeth not engaging said seat teeth when said rack is in said first position, whereby when said rack is in said first position said seat may be raised and lowered by rotating said drive screw and when said rack is in said second position said rack teeth engage said seat teeth restraining vertical motion of said one edge of said seat such that continued rotation of said drive screw causes said seat and the bed frame to rotate about said hub.

19. The lift and tilt mechanism of claim 18 wherein said lift and tilt mechanism is combustible.

20. The lift and tilt mechanism of claim 19 wherein said lift and tilt mechanism is made from plastic.

21. The lift and tilt mechanism of claim 18 wherein said bracket is an elongated integral C-shaped bracket.

22. The lift and tilt mechanism of claim 18 wherein said fasteners are Christmas tree type fasteners integrally associated with said bracket.

23. For a casket having a shell with two end walls and two side walls and a bed frame, a lift and tilt mechanism mountable to the end walls comprising:

a bracket;

fasteners for securing said bracket to the end wall;

a threaded drive screw supported in said bracket for raising and lowering the bed frame;

a hub having threads for threadably engaging said drive screw;

a seat rotatably mounted on said hub for supporting the bed frame; and a restraint mechanism mounted in said bracket, said restraint mechanism being adapted to selectively restrain one side of said seat from vertical motion, whereby when said restraint mechanism is not engaged, said seat may be raised and lowered by rotating said drive screw, and when said restraint mechanism is engaged, vertical motion of said one side of said seat is restrained and continued rotation of said drive screw causes said seat and the bed frame to rotate about said hub.

24. The lift and tilt mechanism of claim 23 wherein said lift and tilt mechanism is combustible.

25. The lift and tilt mechanism of claim 24 wherein said lift and tilt mechanism is made from plastic.

26. The lift and tilt mechanism of claim 23 wherein said bracket is an elongated integral C-shaped bracket.

27. The lift and tilt mechanism of claim 23 wherein said fasteners are integrally associated with said bracket.

28. For a casket having a shell with two end walls and two side walls and a bed frame, a combustible mechanism mountable to the end walls comprising:

an integral C-shaped plastic bracket;

a threaded plastic drive screw rotatably supported in said bracket for raising and lowering the bed frame; and a plastic seat supporting the bed frame having threads threadedly engaging said drive screw.

29. The mechanism of claim 28 further comprising:

plastic tilt means supported in said bracket for tilting the bed frame about a longitudinal axis thereof.

* * * * *